US009388636B2

(12) United States Patent
Winslow et al.

(10) Patent No.: US 9,388,636 B2
(45) Date of Patent: Jul. 12, 2016

(54) APPARATUS AND METHOD FOR DRILLING A WELL

(75) Inventors: Daniel M Winslow, Spring, TX (US); Neelesh Deolalikar, Webster, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 233 days.

(21) Appl. No.: 14/115,035

(22) PCT Filed: May 13, 2011

(86) PCT No.: PCT/US2011/036379

§ 371 (c)(1),
(2), (4) Date: Oct. 31, 2013

(87) PCT Pub. No.: WO2012/158144

PCT Pub. Date: Nov. 22, 2012

(65) Prior Publication Data

US 2014/0060935 A1 Mar. 6, 2014

(51) Int. Cl.
*E21B 7/06* (2006.01)
*E21B 7/04* (2006.01)

(52) U.S. Cl.
CPC . *E21B 7/068* (2013.01); *E21B 7/04* (2013.01); *E21B 7/067* (2013.01)

(58) Field of Classification Search
CPC ..... E21B 7/04; E21B 7/067; E21B 7/06; E21B 7/068; E21B 43/00; E21B 4/02; E21B 4/006; E21B 7/062; E21B 13/15747
See application file for complete search history.

(56) References Cited

U.S. PATENT DOCUMENTS

| | | | | |
|---|---|---|---|---|
| 3,045,750 | A * | 7/1962 | Peters | E21B 43/00 166/250.01 |
| 4,811,798 | A | 3/1989 | Falgout, Sr. et al. | |
| 5,396,966 | A | 3/1995 | Roos, Jr. et al. | |
| 5,737,357 | A | 4/1998 | Retzer | |
| 6,059,050 | A | 5/2000 | Gray | |
| 6,213,226 | B1 | 4/2001 | Eppink et al. | |
| 6,581,699 | B1 | 6/2003 | Chen et al. | |
| 6,598,687 | B2 | 7/2003 | Eppink et al. | |
| 6,607,044 | B1 | 8/2003 | Eppink et al. | |
| 6,843,332 | B2 | 1/2005 | Eppink et al. | |
| 7,028,789 | B2 | 4/2006 | Krueger et al. | |
| 7,083,010 | B2 | 8/2006 | Eppink et al. | |
| 7,147,066 | B2 | 12/2006 | Chen et al. | |
| 7,195,083 | B2 | 3/2007 | Eppink et al. | |
| 7,243,739 | B2 | 7/2007 | Rankin, III et al. | |
| 7,287,604 | B2 | 10/2007 | Aronstam et al. | |
| 7,306,060 | B2 | 12/2007 | Krueger et al. | |
| 7,383,897 | B2 | 6/2008 | Moody et al. | |
| 7,467,673 | B2 | 12/2008 | Earles et al. | |
| 7,506,696 | B2 | 3/2009 | Weston et al. | |
| 7,510,027 | B2 | 3/2009 | Weston et al. | |

(Continued)

*Primary Examiner* — Yong-Suk (Philip) Ro
(74) *Attorney, Agent, or Firm* — McGuireWoods, LLP

(57) ABSTRACT

A method for forming a controllable bend angle in a drill string in a wellbore comprises attaching an upper housing to a drill string. At least, one drive motor is anchored in the upper housing. A middle housing is operably coupled to the at least one drive motor. A lower housing is operably coupled to the at least one drive motor. The at least one drive motor is controllably operated to rotate the middle housing by a first rotation angle with respect to the upper housing, and to rotate the lower housing by a second rotation angle with respect to the upper housing, to generate a desired bend angle between the middle housing and the lower housing at a target toolface orientation between the bend angle and the upper housing.

19 Claims, 10 Drawing Sheets

(56) References Cited

U.S. PATENT DOCUMENTS 7,621,343 B2 11/2009 Chen et al.
2001/0052427 A1* 12/2001 Eppink ..... E21B 4/006 175/40
2002/0166701 A1* 11/2002 Comeau ..... E21B 4/02 175/61
2009/0050370 A1* 2/2009 Peters ..... E21B 7/06 175/45
2009/0260884 A1* 10/2009 Santelmann ..... E21B 7/062 175/61
2011/0100716 A1* 5/2011 Shepherd ..... A61F 13/15747 175/73
2011/0101716 A1 5/2011 Nolte et al.

* cited by examiner

APPARATUS AND METHOD FOR DRILLING A WELL

BACKGROUND OF THE INVENTION

The present disclosure relates generally to the field of drilling wells and more particularly to steerable drilling tools.

In deviated and horizontal drilling applications it is advantageous to use rotary steerable systems to prevent pipe sticking in the deviated and horizontal sections. It would also be advantageous to have the ability to have a drilling motor and bent sub for changing direction. In operation, it would be desirable to have the motor, and the bent sub non-rotating with respect to the borehole while changing direction. At the same time, it is advantageous to have the drill string rotating to prevent differential sticking and to reduce friction with the borehole wall. The present disclosure describes a downhole adjustable bent housing for rotary steerable drilling.

BRIEF DESCRIPTION OF THE DRAWINGS

A better understanding of the present invention can be obtained when the following detailed description of example embodiments are considered in conjunction with the following drawings, wherein like elements have like numbers, in which.

Figure 1:
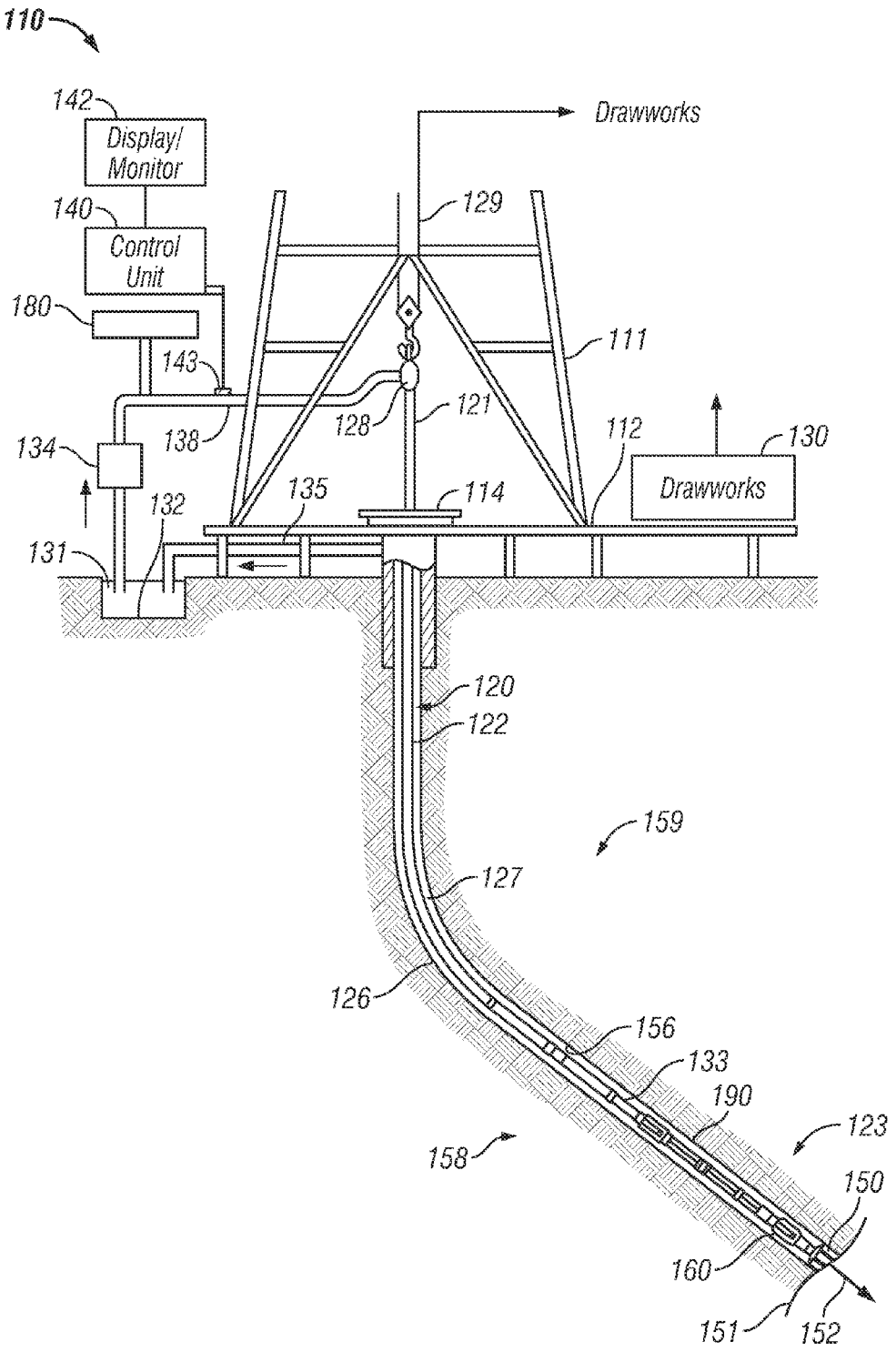
FIG. 1 shows a schematic diagram of a drilling system.

While the invention is susceptible to various modifications and alternative forms, specific embodiments thereof are shown by way of example in the drawings and will herein be described in detail. It should be understood, however, that the drawings and detailed description herein are not intended to limit the invention to the particular form disclosed, but on the contrary, the intention is to cover all modifications, equivalents and alternatives falling within the scope of the present invention as defined by the appended claims.

DETAILED DESCRIPTION

Described below are several illustrative embodiments of the present invention. They are meant as examples and not as limitations on the claims that follow.

FIG. 1 shows a schematic diagram of a drilling system 110 having a downhole assembly according to one embodiment of present invention. As shown, the system 110 includes a conventional derrick 111 erected on a derrick floor 112 which supports a rotary table 114 that is rotated by a prime mover (not shown) at a desired rotational speed. A drill string 120 that includes a drill pipe section 122 extends downward from rotary table 114 into a directional borehole 126. Borehole 126 may travel in a three-dimensional path. The three-dimensional direction of the bottom 151 of borehole 126 is indicated by a pointing vector 152. A drill bit 150 is attached to the downhole end of drill string 120 and disintegrates the geological formation 123 when drill bit 150 is rotated. The drill string 120 is coupled to a drawworks 130 via a kelly joint 121, swivel 128 and line 129 through a system of pulleys (not shown). During the drilling operations, drawworks 130 is operated to control the weight on bit 150 and the rate of penetration of drill string 120 into borehole 126. The operation of drawworks 130 is well known in the art and is thus not described in detail herein.

During drilling operations a suitable drilling fluid (commonly referred to in the art as "mud") 131 from a mud pit 132 is circulated under pressure through drill string 120 by a mud pump 134. Drilling fluid 131 passes from mud pump 134 into drill string 120 via fluid line 138 and kelly joint 121. Drilling fluid 131 is discharged at the borehole bottom 151 through an opening in drill bit 150. Drilling fluid 131 circulates uphole through the annular space 127 between drill string 120 and borehole 126 and is discharged into mud pit 132 via a return line 135. Preferably, a variety of sensors (not shown) are appropriately deployed on the surface according to known methods in the art to provide information about various drilling-related parameters, such as fluid flow rate, weight on bit, hook load, etc.

A surface control unit 140 may receive signals from downhole sensors and devices via a sensor 143 placed in fluid line 138 and processes such signals according to programmed instructions provided to surface control unit 140. Surface control unit 140 may display desired drilling parameters and other information on a display/monitor 142 which may be used by an operator to control the drilling operations. Surface control unit 140 may contain a computer, memory for storing data, data recorder and other peripherals. Surface control unit 140 may also include models and may process data according to programmed instructions, and respond to user commands entered through a suitable input device, such as a keyboard (not shown).

In one example embodiment of the present invention, a steerable drilling bottom hole assembly (BHA) 159 may comprise a measurement while drilling (MWD) system 158 comprising various sensors to provide information about the formation 123 and downhole drilling parameters. BHA 159 may be coupled between the drill bit 150 and the drill pipe 122.

MWD sensors in BHA 159 may include, but are not limited to, a device for measuring the formation resistivity near the drill bit, a gamma ray device for measuring the formation gamma ray intensity, devices for determining the inclination and azimuth of the drill string, and pressure sensors for measuring drilling fluid pressure downhole. The above-noted devices may transmit data to a downhole transmitter 133, which in turn transmits the data uphole to the surface control unit 140. In one embodiment a mud pulse telemetry technique may be used to communicate data from downhole sensors and devices during drilling operations. A transducer 143 placed in the mud supply line 138 detects the mud pulses responsive to the data transmitted by the downhole transmitter 133. Transducer 143 generates electrical signals in response to the mud pressure variations and transmits such signals to surface control unit 140. Alternatively, other telemetry techniques such as electromagnetic and/or acoustic techniques or any other suitable technique known in the art may be utilized for the purposes of this invention. In one embodiment, hard wired drill pipe may be used to communicate between the surface and downhole devices. In one example, combinations of the techniques described may be used. In one embodiment, a surface transmitter receiver 180 communicates with downhole tools using any of the transmission techniques described, for example a mud pulse telemetry technique. This may enable two-way communication between surface control unit 140 and the downhole tools described below. BHA 159 may also comprise a drilling motor 190.

Figure 2A:
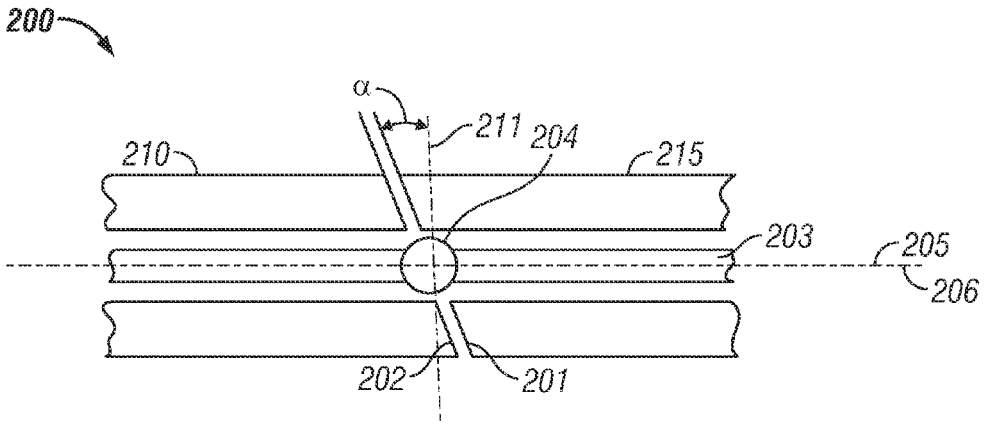
FIGS. 2A and 2B show a simplified view of an adjustable bent housing having angled faces.
Figure 2B:
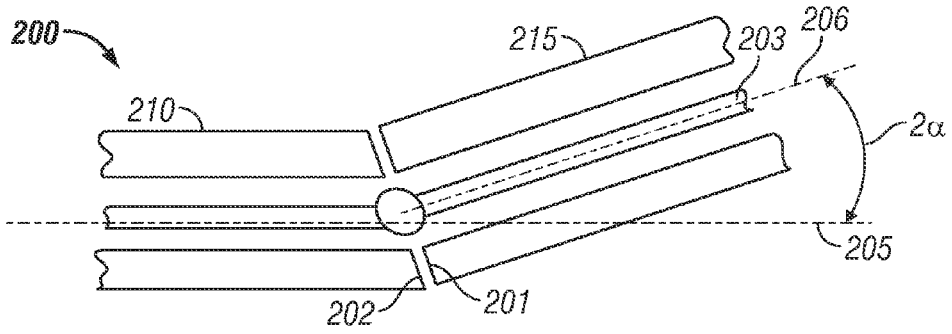

In one embodiment, BHA 159 may comprise a downhole steering assembly having an adjustable bent housing 160 or 660. FIGS. 2A and 2B show a simplified view of a bent housing 200 having a first housing 210 and a second housing 215 having mating faces 202 and 201, respectively. In FIG. 2A the housings 210 and 215 are aligned such that their centerlines 205 and 206 are substantially aligned. The mating faces 201 and 202 are angled by an angle $\alpha$ from a plane 211 that is perpendicular to the centerlines 205 and 206. FIG. 2B shows the result when housing 215 is rotated 180° from the position of 2A. The result is that the centerline 206 of housing 215 is angled from the centerline 205 of housing 210 by an angle of $2\alpha$. Rotation of housing 215 between 0-180° results in an angle between 0-$2\alpha$. In some examples, centerline 205 is substantially parallel to a centerline of the wellbore. The resulting bend angle of housing 215 allows for deviations in the trajectory of the wellbore.

Figure 3:
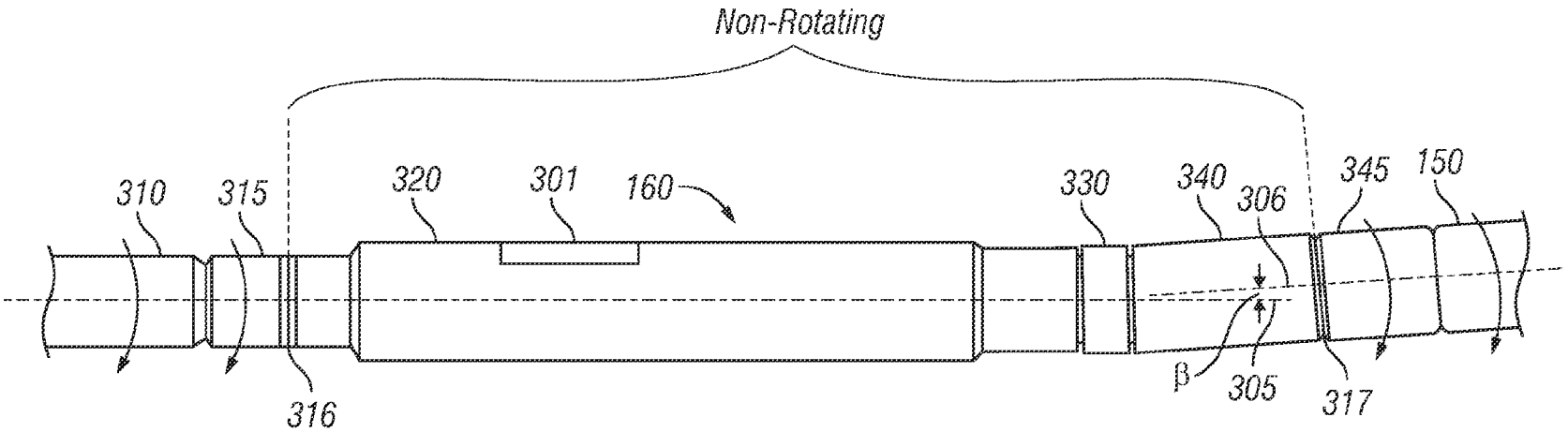
FIG. 3 shows an example of an adjustable bent housing assembly.

FIG. 3 shows an example of an adjustable bent housing assembly 160 attached to a rotating portion 310 of BHA 159. In one example, the rotating member 310 may be an output shaft of drilling motor 190. Alternatively, rotating member 310 may comprise a rotating element in drill string 120. Rotating member 310 is coupled to input shaft 315. Input shaft 315 rotates with rotating member 310. Input shaft 315 extends through bores in first housing 320, second housing 330 and third housing 340, and couples to rotating output shaft 345. First housing 320, second housing 330 and third housing 340 are substantially non-rotating as the term is defined below. Output shaft 345 is coupled to drill bit 150. As used herein, the term "non-rotating" is intended to mean that the element does not rotate during steering operations, while the rest of drill string 120 and bit 150 may be rotating. In one example, input shaft 315 and output shaft 345 are separated from non-rotating housings 320 and 340 by bearing assemblies 316 and 317. As shown in FIG. 3, in operation the centerline 306 of third housing 340 may be deviated by an angle $\beta$ with respect to centerline 305 of the upper drill string components.

Figure 4:
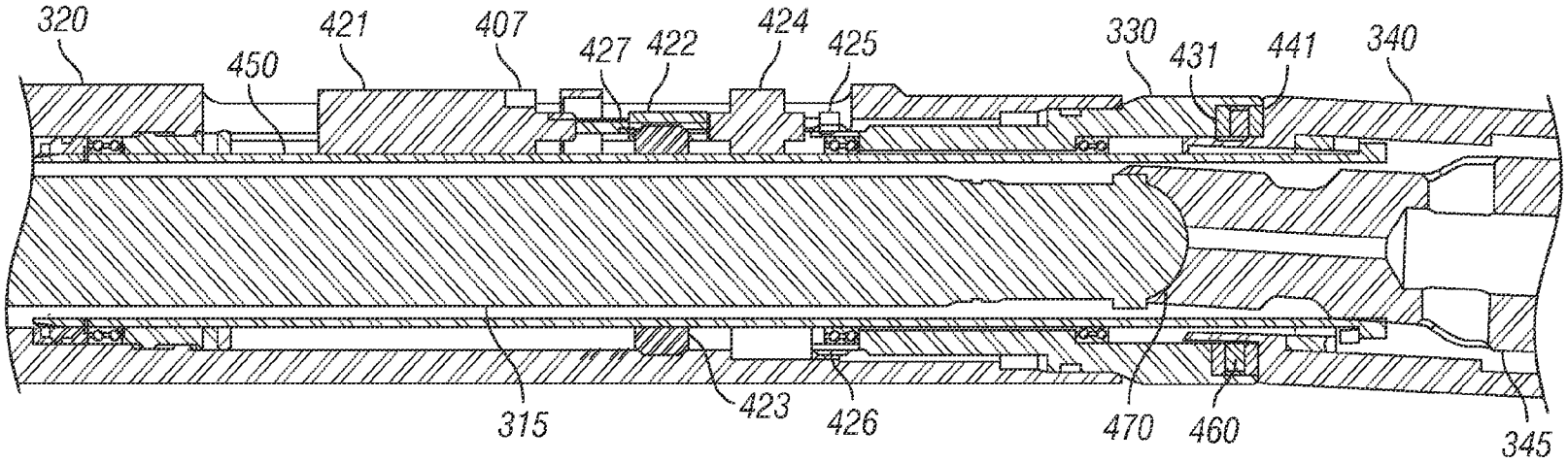
FIG. 4 shows a section view of a portion of one embodiment of an adjustable bent housing assembly.

FIG. 4 shows a section view of a portion of one embodiment of adjustable bent housing assembly 160. In the example shown, middle housing 330 and lower housing 340 have angled faces 431 and 441 similar to those described in FIGS. 3A and 3B. Face 431 engages face 441 through thrust bearing 460 thereby allowing relative rotation between middle housing 330 and lower housing 340. Similarly, upper housing 320 is able to rotate relative to middle housing 330. A steering sleeve 450 extends from upper housing 320, through the middle housing 330, and is coupled to the lower housing 340 by constant velocity joint 470. Steering sleeve 450 is selectively rotatable with relation to upper housing 320 and/or middle housing 330 via a drive assembly 420. In this example, drive assembly 420 comprises a motor 421, a spur gear 422, a ring gear 423, a clutch 424, a clutch spur gear 425, and a clutch ring gear 426. Motor 421 may be anchored with respect to upper housing 320. In one example, motor 421 may be an electrical motor. Alternatively, motor 421 may be a hydraulic motor.

Motor 421 has spur gear 422 attached to a motor output shaft 427. Spur gear 421 engages ring gear 423 attached around steering sleeve 450, such that motor 421 rotation causes rotation of steering sleeve 450 and thus lower housing 340 with respect to upper housing 320. In the example shown, clutch 424 is engaged to an extension of shaft 427. Clutch 424 is anchored to upper housing 320. An output shaft of clutch 424 has a clutch gear 425 mounted thereon. Clutch gear 425 engages clutch ring gear 426 attached around second housing 330. In one example, clutch 424 is configured to operate in one of two positions. In one position, clutch 424 operably couples clutch gear 425 to rotate along with spur gear 421 thereby rotating both middle housing 330 and lower housing 340 together with respect to upper housing 320. In a second position, clutch 424 may operate to disengage clutch gear 425 from rotating with spur gear 421, while also preventing rotation of clutch gear 425, effectively locking middle housing 330 to upper housing 320. In one example, when middle housing 330 is locked to upper housing 320, steering sleeve 450 may be rotated to rotate lower housing 340 with respect to middle housing 330 to generate the desired bend angle $\beta$. With middle housing 330 locked to lower housing 340, steering sleeve 450 may be rotated to rotate the bend into the desired tool face direction. A sealed cover, not shown, is located over the openings in upper housing 320 allowing the rotating elements to be immersed in a non-conductive fluid, for example a non-conductive oil.

Figure 9:
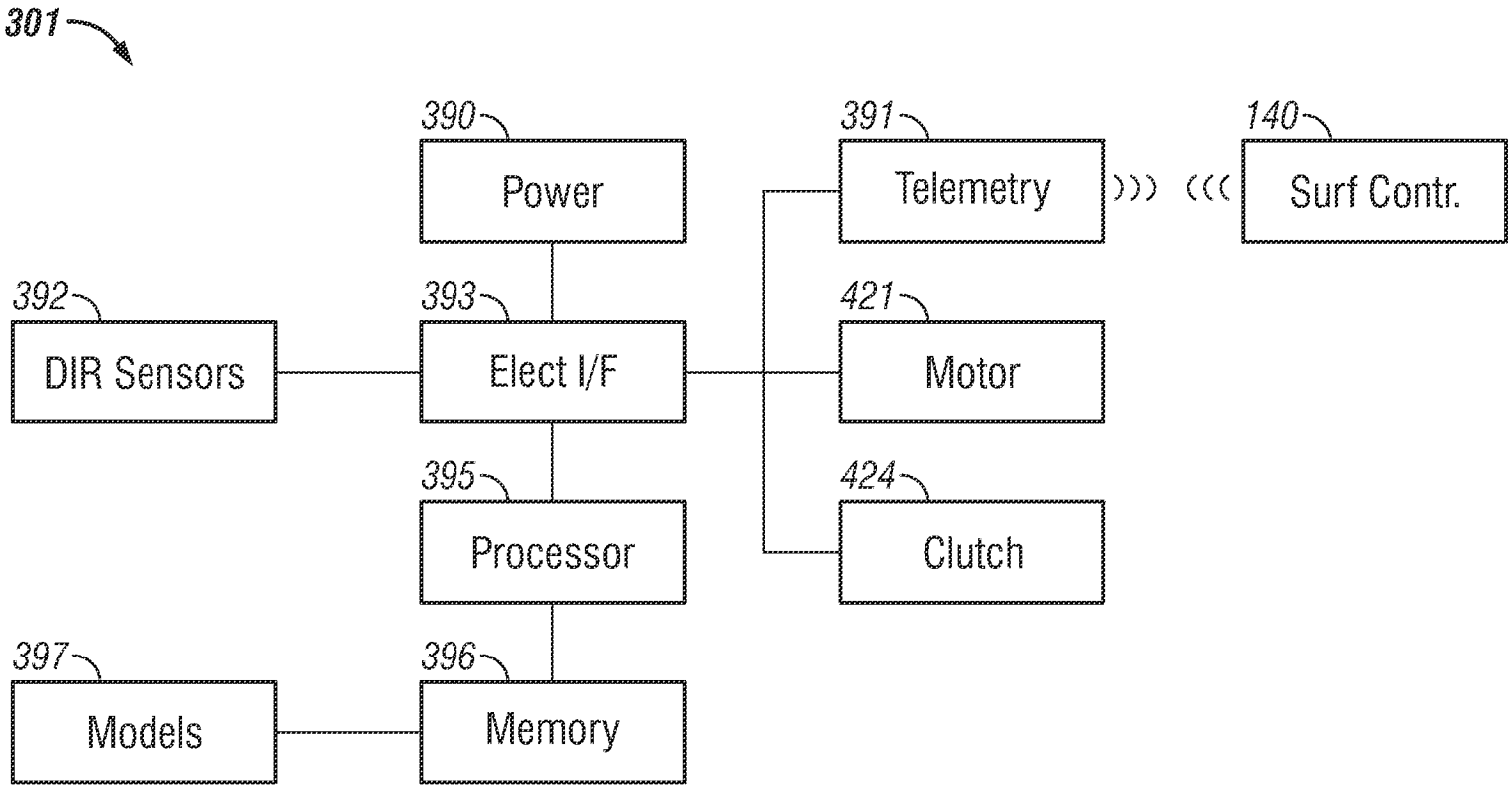
FIG. 9 shows a block diagram of one embodiment of an adjustable bent housing.

In one example, see FIG. 9, electronics 301 may be located in upper housing 320 to control the operation of bent sub assembly 160. In one example well trajectory models 397 may be stored in a memory 396 in data communications with a processor 395 in the electronics 301. Directional sensors 392 may be mounted in upper housing 320 or elsewhere in the BHA, and may be used to determine the inclination and azimuth of the steering assembly. Directional sensors may include, but are not limited to: azimuth sensors, inclination sensors, gyroscopic sensors, magnetometers, and three-axis accelerometers. Depth measurements may be made at the surface and/or downhole for calculating the axial location of the steering assembly. If depth measurements are made at the surface, they may be transmitted to the downhole assembly using telemetry system 391. In operation, electronic interface circuits 393 may distribute power from power source 390 to directional sensors 392, processor 395, telemetry system 391, and motor 321. In addition, electronic interface circuits 393 may transmit and/or receive data and command signals from directional sensors 392, processor 395, telemetry system 391, and motor 321. An angular rotation sensor 407 may be used to determine the rotational position of middle housing 330 and lower housing 340 relative to upper housing 320. Power source 390 may comprise batteries, a downhole generator/alternator, and combinations thereof. In one embodiment, models 397 comprise directional position models to control the steering assembly, including the adjustable bent housing, to control the direction of the wellbore along a predetermined trajectory. The predetermined trajectory may be 2 dimensional and/or 3 dimensional. In addition models 387 may comprise instructions that evaluate the readings of the directional sensors to determine when the well path has deviated from the desired trajectory. Models 397 may calculate and control corrections to the toolface and bent housing angle to make adjustments to the well path based on the detected deviations. In one example, models 397 may adjust the well path direction to move back to the original predetermined trajectory. In another, example, models 397 may calculate a new trajectory from the deviated position to the target, and control the steering assembly to follow the new path. Alternatively, direction sensor data may be transmitted to the surface, corrections calculated at the surface, and commands from the surface may be transmitted to the downhole tool to alter the settings of the bent housing.

Figure 5:
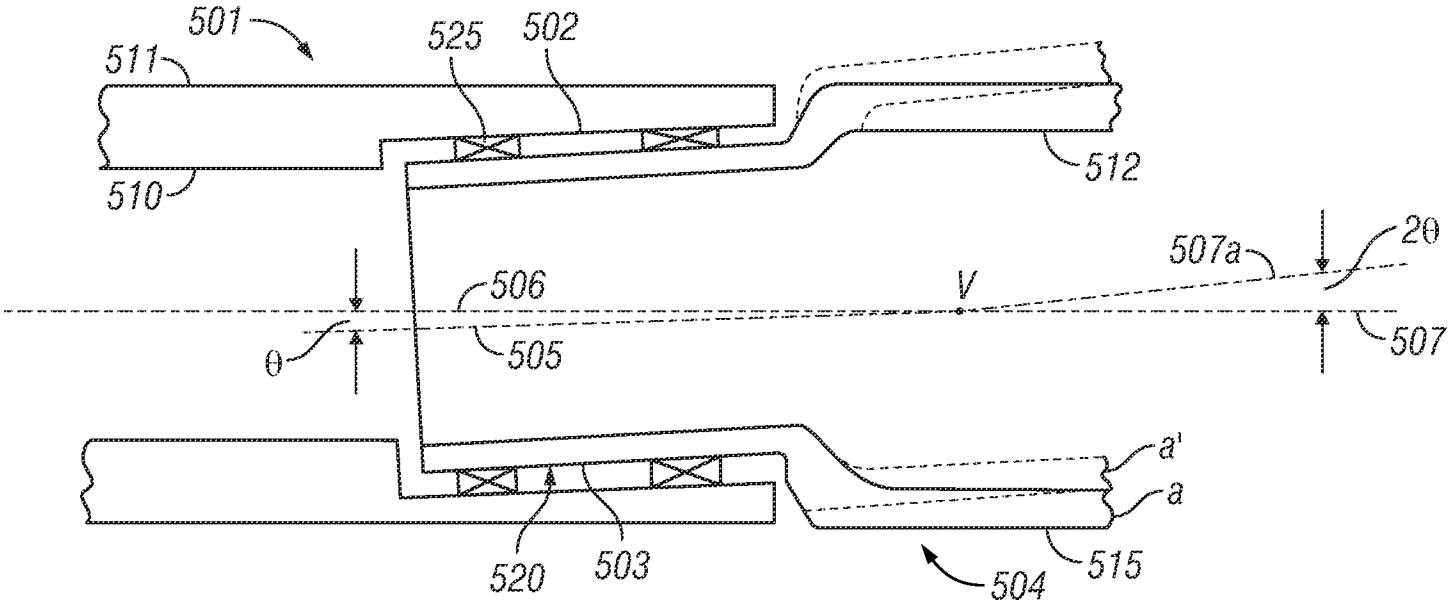
FIG. 5 shows a simplified view of another embodiment of an adjustable bent housing.

FIG. 5 presents a simplified view of another technique for developing an angle between two housings of an adjustable bent housing. As shown in FIG. 5, a housing 501 has a bore 510 therethrough. Housing 501 and bore 510 are each substantially concentric about centerline 506. At a lower end, housing 501 has an angled bore 502 formed therein. The centerline 505 of bore 502 is offset by an angle θ from the centerline 506 of bore 510 of housing 501. A mating housing 504 has an angled mandrel 520 that is formed on an end of mating housing 504 such that a centerline of the angled end is at the angle θ from centerline 506 of the main portion 515 of mating housing 504, when the angled end 520 is properly mounted in the angled bore 502. In one example bearings 525 are mounted between angled end 520 and bore 502 to allow rotation there between. As shown in FIG. 5, mating housing 504 may be rotated with respect to housing 501. When mating housing 504 is rotated 180°, the result is that the centerline 507*a* of housing 504 is angled from the centerline 506 of housing 501 by an angle of 2θ. Rotation of housing 504 between 0-180° results in an angle between 0-2θ. The resulting bend angle of housing 504 with respect to housing 501 allows for deviations in the trajectory of the wellbore generally in the direction of the bend and in the plane containing the axes 506 and 507*a*. The plane of the bend angle may be referred to as the toolface of the bent housing assembly. The toolface angle may be referred to as the angle between the toolface of the bent housing assembly and the gravity high side of the wellbore in deviated wells, and the angle between the toolface of the bent housing assembly and magnetic north in substantially vertical wells.

Figure 6:
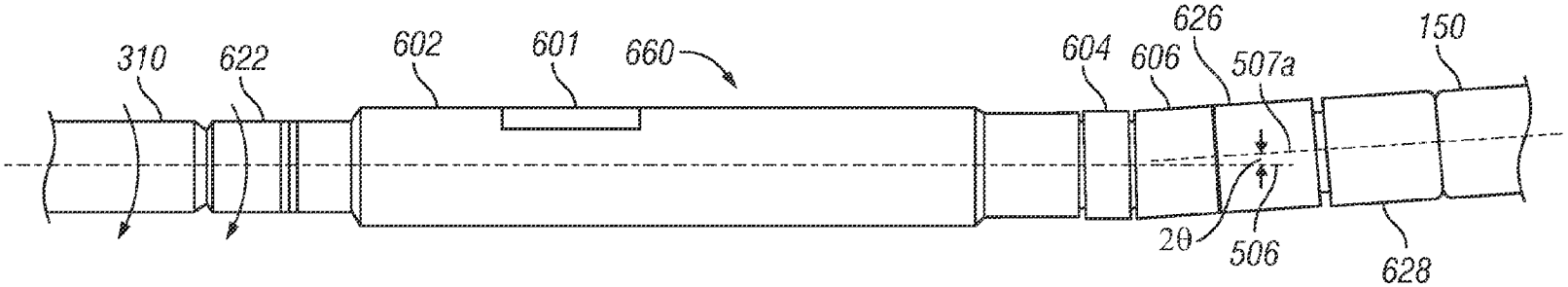
FIG. 6 shows another example of an adjustable bent housing assembly comprising an angled housing and mandrel.

FIG. 6 shows another example of an adjustable bent housing assembly 660 using the angled housing and mandrel discussed in relation to FIG. 5. Bent housing assembly 660 may be attached to a rotating portion 310 of BHA 159, similar to adjustable bent housing 160 of FIG. 1. In one example, the rotating member 310 may be an output shaft of drilling motor 190. Alternatively, rotating member 310 may comprise a rotating element in drill string 120. Rotating member 310 is coupled to input shaft 622. Input shaft 622 rotates with rotating member 310. Input shaft 622 extends through bores in upper housing 602, middle housing 604, and lower housing 606, and rotationally couples to rotating output shaft 628 through spline 670. Upper housing 602, middle housing 604 and lower housing 606 are substantially non-rotating as the term is defined below. Output shaft 628 extends through bearing section 626 and is coupled to drill bit 150. As used herein, the term "non-rotating" is intended to mean that the element does not rotate during steering operations, while at least a portion of the drill string 120 and bit 150 are rotating. In one example, input shaft 315 and output shaft 345 may be separated from non-rotating housings 320 and 340 by bearings, described in more detail below. As shown in FIG. 6, in operation the centerline 507 of lower housing 606 may be deviated by an angle 2θ with respect to centerline 506 of the upper drill string components, enabling deviations in the trajectory of the wellbore.

Figure 7:
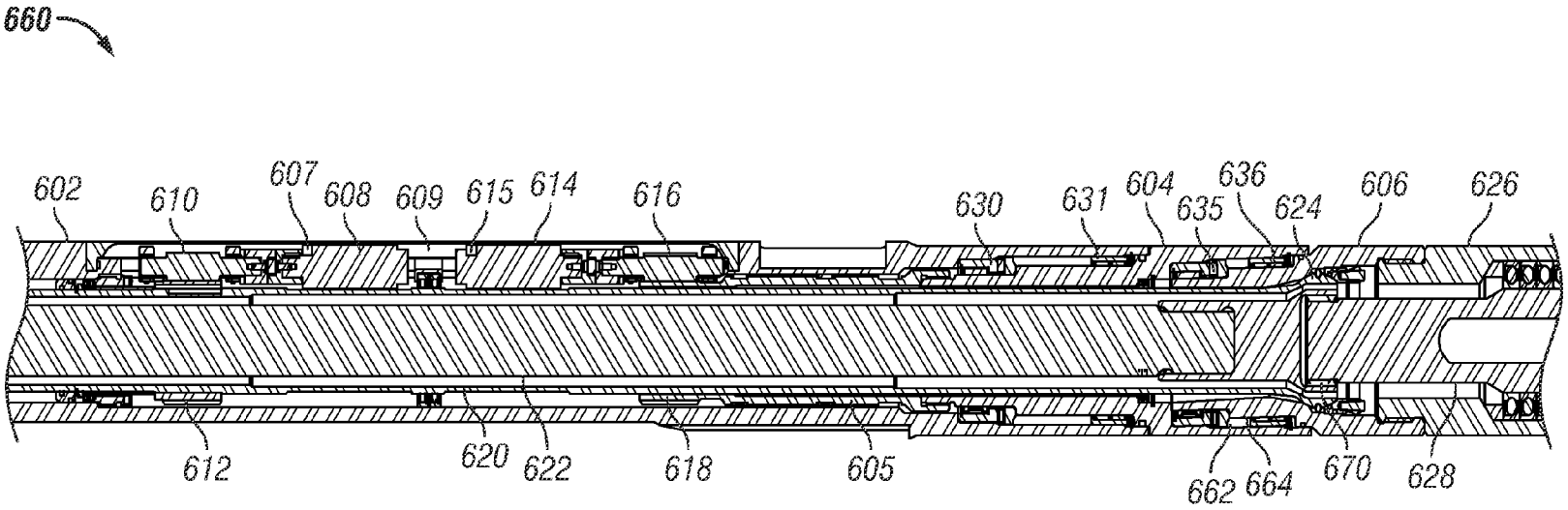
FIG. 7 shows a section view of a portion of an adjustable bent housing incorporating an angled housing and mandrel.

FIG. 7 shows a section view of a portion of an adjustable bent housing incorporating an angled housing and mandrel discussed in relation to FIGS. 5 and 6. As shown, upper housing 602 is rotatably mounted to middle housing 604 by bearings 630 and 631. Bearings and 631 may comprise radial and thrust bearings commonly known in the art. Similarly, middle housing 604 is rotatably mounted to lower housing 606 by bearings 635 and 636 that may comprise radial and thrust bearings known in the art. In one example, the bearings 630 and 631 and 635 and 636 are located in oil filled sections of the tool. In one example, commercial anti-friction type bearings may be used. In the example shown, a first drive motor 608 is anchored in a cavity 609 in upper housing 602. First drive motor 608 is mechanically operatively coupled to constant velocity joint 624. First drive motor 608 drives first spur gear 610 that is engaged with first ring gear 612. First ring gear 612 is attached to first drive sleeve 620 that is in turn attached to constant velocity joint 624. Constant velocity joint 624 is mechanically coupled to lower housing 606 such that rotation of first drive sleeve 620 results in equivalent rotation of lower housing 606. Constant velocity joints are known in the art and are not described in detail. In one example, first drive motor 608 may be a stepper motor known in the art to provide discreetly controllable rotational movement. Alternatively, first drive motor 608 may be a hydraulic motor. In one embodiment, first drive motor 608 may incorporate a sensor 607 to measure the rotational motion and/or position of an output shaft of first drive motor 608. Controllable rotation of first drive motor 608 results in controllable rotation of lower housing 606, with respect to upper housing 602.

Similarly, second drive motor 614 is anchored in cavity 609 in upper housing 602. Second drive motor 609 drives second spur gear 616 that is engaged with second ring gear 618. Second ring gear 618 is attached to sleeve 605 that is attached to middle housing 604. Second drive motor 614 may be a stepper motor known in the art to provide discreetly controllable rotational movement. Alternatively, second drive motor 614 may be a hydraulic motor. Second drive motor 614 may incorporate a sensor 615 to measure the rotational motion and/or position of an output shaft of second drive motor 614 drive motor 614. Controllable rotation of second drive motor 614 results in controllable rotation of middle housing 606 with respect to upper housing 602.

Figure 8:
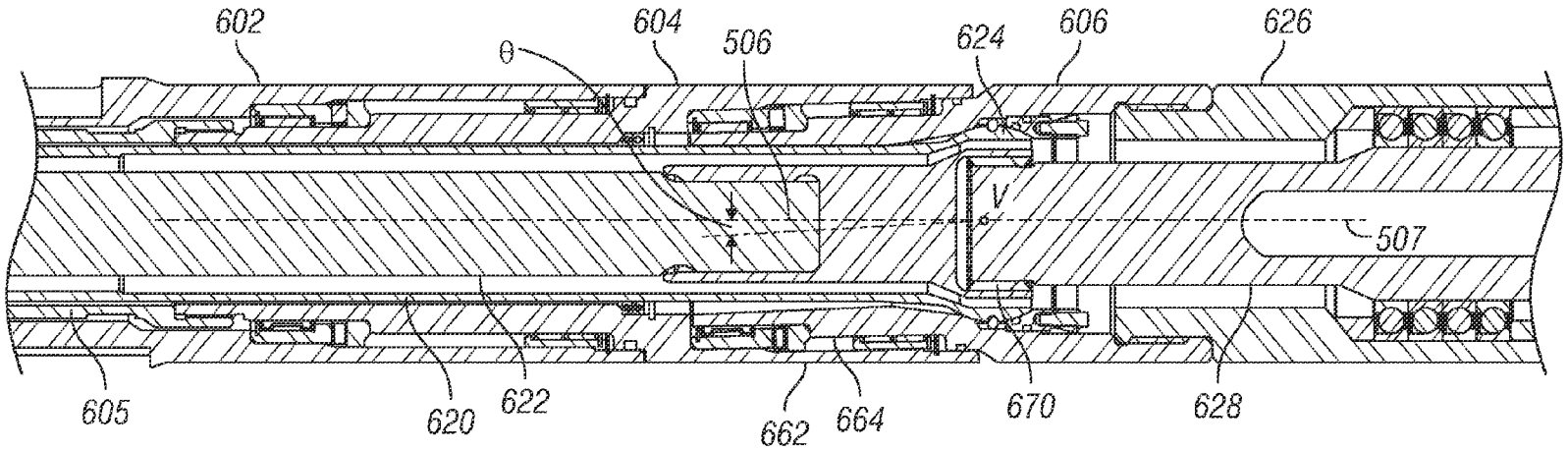
FIG. 8 shows an enlarged section view of a portion of FIG. 7.

FIG. 8 shows an enlarged section view of a portion of FIG. 7, wherein middle housing 604 incorporates an angled bore 662, sized to accept an angled mandrel 664 loaned on the upper end of lower housing 606, as described with respect to FIG. 5. The bore 662 and the mandrel 664 may be angled by an angle θ with respect to the centerline 506. Rotation of lower housing 606 with respect to middle housing 604 generates a bent angle between lower housing 606 and both middle housing 604 and upper housing 602. As one skilled in the art will appreciate, during steering the upper housing 602 may be substantially non-rotating with respect to the wellbore being drilled. In order to generate a desired bend angle at the desired toolface orientation, the appropriate rotations of each of middle housing 604 and lower housing 606 may be calculated with respect to the upper housing 602, and each housing may be rotated consecutively to the desired rotational setting for each, respectively, to generate the desired bend angle and the desired toolface direction. Alternatively, lower housing 606 may be rotated with respect to middle housing 604 to generate the desired bend angle. Then, both middle housing 604 and lower housing 606 may be concurrently rotated to the desired toolface orientation. The sequential operation may significantly lower the peak power demands compared to the concurrent operation described above, as only one motor needs to operate at a time.

Figure 10:
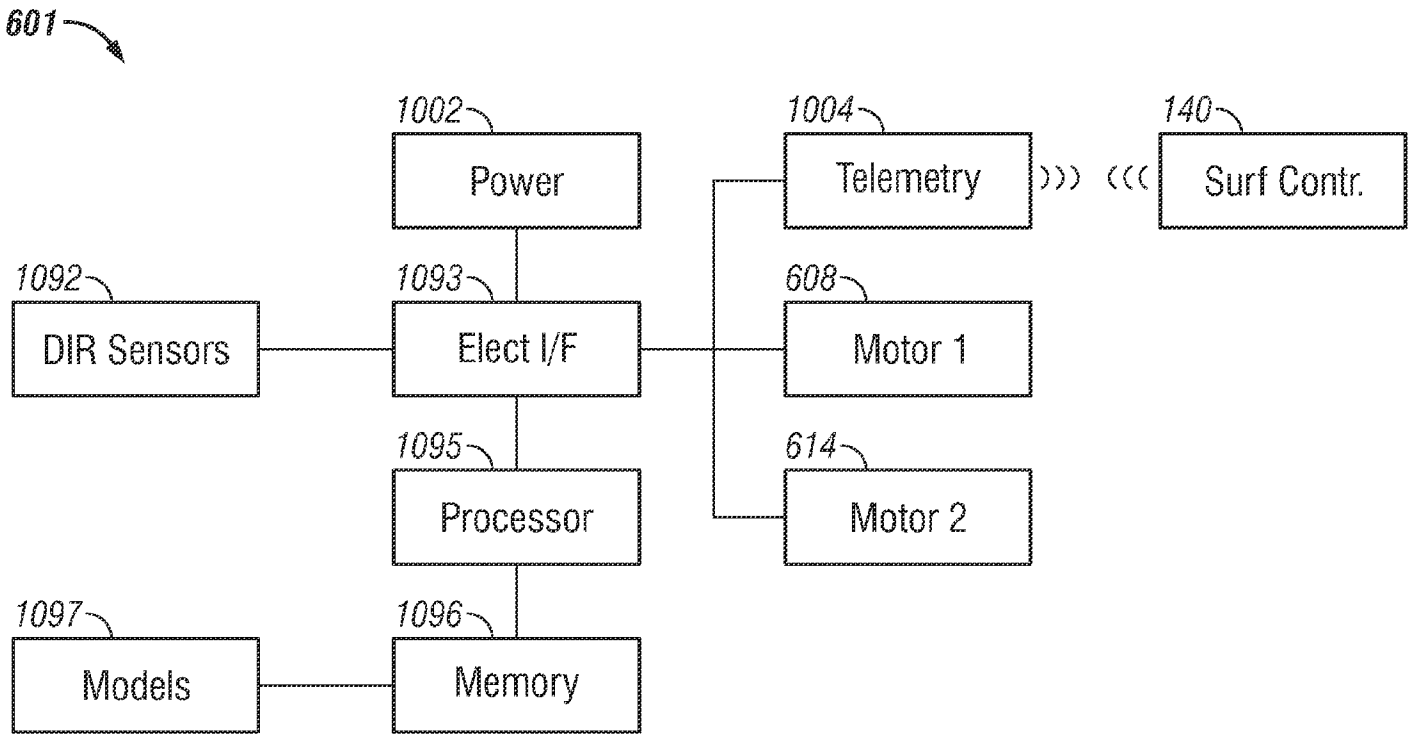
FIG. 10 shows a-block diagram of another embodiment of an adjustable bent housing.

In one example, see FIG. 10, electronics 601 (see FIG. 6) may be located in upper housing 602 to control the operation of bent housing assembly 660. In one example well trajectory models 1097 may be stored in a memory 1096 that is in data communications with a processor 1095 in the electronics 601. Directional sensors 1092 may be mounted in upper housing 602 or elsewhere in the BHA, and may be used to determine the inclination and azimuth of the steering assembly. Directional sensors may include, but are not limited to: azimuth sensors, inclination sensors, gyroscopic sensors, magnetometers, and three-axis accelerometers. Depth measurements may be made at the surface and/or downhole for calculating the axial location of the steering assembly. If depth measurements are made at the surface, they may be transmitted to the downhole assembly using telemetry system 1091. In operation, electronic interface circuits 1093 may distribute power from power source 1090 to directional sensors 1092, processor 1095, telemetry system 1091, first motor 608, and second motor 614. In addition, electronic interface circuits 1093 may transmit and/or receive data and command signals from directional sensors 1092, processor 1095, telemetry system 1091, first motor 608, and second motor 614. Angular rotation sensors 607 and 615 may be used to determine the rotational positions of middle housing 604 and lower housing 606 relative to upper housing 602. Power source 1002 may comprise batteries, a downhole generator/alternator, and combinations thereof. In one embodiment, models 1097 comprise directional position models to control the steering assembly, including the adjustable bent housing, to control the direction of the wellbore along a predetermined trajectory. The predetermined trajectory may be 2 dimensional and/or 3 dimensional. In addition models 1097 may comprise instructions that evaluate the readings of the directional sensors to determine when the well path has deviated from the desired trajectory. Models 1097 may calculate and control corrections to the toolface and bent housing angle to make adjustments to the well path based on the detected deviations. In one example, models 1097 may adjust the well path direction to move back to the original predetermined trajectory. In another, example, models 1097 may calculate a new trajectory from the deviated position to the target, and control the steering assembly to follow the new path. In one example, the measurements, calculations, and corrections are autonomously executed downhole. Alternatively, direction sensor data may be transmitted to the surface, corrections calculated at the surface, and commands from the surface may be transmitted to the downhole tool to alter the settings of the bent housing.

Numerous variations and modifications will become apparent to those skilled in the art. It is intended that the following claims be interpreted to embrace all such variations and modifications.

The invention claemed is:

1. An apparatus comprising:

a drill string deployed in a wellbore an upper housing attached to the drill string;

at least one drive motor anchored to the upper housing;

a middle housing operably coupled to the at least one drive motor to controllably rotate the middle housing with respect to the upper housing;

a lower housing operably coupled to the at least one drive motor to controllably rotate the lower housing with respect to the upper housing;

a controller operably coupled to the at least one drive motor to controllably rotate the middle housing by a first rotation angle with respect to the upper housing, and to controllably rotate the lower housing by a second rotation angle with respect to the upper housing to generate a desired bend angle between the middle housing and the lower housing at a target toolface orientation between the bend angle and the upper housing; and an angled bore formed in a lower end of the middle housing and operably coupled to an angled mandrel formed into an upper end of the lower housing such that relative rotation of the middle housing and the lower housing generates the bend angle.

2. The apparatus of claim 1 further comprising a controllable clutch anchored to the upper housing to selectively couple the middle housing to the upper housing.

3. The apparatus of claim 1 further comprising a constant velocity joint to operably couple the lower housing to the upper housing.

4. The apparatus of claim 1 further comprising a first angled face formed in a lower end of the middle housing and operably coupled to a second matching angled face formed into an upper end of the lower housing such that relative rotation of the middle housing and the lower housing generates the bend angle.

5. The apparatus of claim 1 wherein the at least one drive motor comprises a first drive motor operably coupled to the lower housing and a second drive motor operably coupled to the middle housing.

6. The apparatus of claim 5 wherein the controller actuates each of the first drive motor and the second drive motor sequentially to rotate the lower housing and the middle housing with respect to the upper housing.

7. The apparatus of claim 1 wherein the controller is located at least one of the surface and downhole.

8. The apparatus of claim 1 wherein the controller is located downhole, the controller comprising a processor in data communication with a memory, the processor containing programmed instructions to autonomously control the bend angle and toolface to drill the wellbore along a predetermined path.

9. A method for forming a controllable bend angle in a drill string in a wellbore comprising:

attaching an upper housing to a drill string;

anchoring at least one drive motor in the upper housing;

operably coupling a middle housing to the at least one drive motor;

operably coupling a lower housing to the at least one drive motor;

controllably operating the at least one motor downhole to rotate the middle housing by a first rotation angle with respect to the upper housing and to rotate the lower housing by a second rotation angle with respect to the upper housing to generate a desired bend angle between the middle housing and the lower housing at a target toolface orientation between the bend angle and the upper housing; and forming an angled bore in a lower end of the middle housing; forming an angled mandrel into an upper end of the lower housing; and operably coupling the angled bore and the angled mandrel such that relative rotation of the middle housing and the lower housing generates the bend angle.

10. The method of claim 9 wherein operably coupling the middle housing to the at least one drive motor comprises operably coupling the middle housing through a selectively operable clutch to the at least one drive motor.

11. The method of claim 9 wherein operably coupling the lower housing to the at least one drive motor comprises operably coupling the lower section through a constant velocity joint to the at least one drive motor.

12. The method of claim 9 further comprising forming a first angled face in a lower end of the middle housing; forming a second matching angled face into an upper end of the lower housing; and operably coupling the angled faces such that relative rotation of the middle housing and the lower housing generates the bend angle.

13. The method of claim 9 wherein anchoring at least one drive motor in the upper housing comprises anchoring each of a first drive motor and a second drive motor to the upper housing and operably coupling the first drive motor to the lower housing and the second drive motor to the middle housing.

14. The method of claim 13 further comprising controllably actuating each of the first drive motor and the second drive motor to rotate the lower housing and the middle housing with respect to the upper housing in at least one of: a sequential actuation and a concurrent actuation.

15. An apparatus comprising:

an upper housing;

a first drive motor anchored to the upper housing;

a second drive motor anchored to the upper housing;

a middle housing operably coupled to the second drive motor to controllably rotate the middle housing with respect to the upper housing;

a lower housing operably coupled to the first drive motor to controllably rotate the lower housing with respect to the upper housing;

a controller operably coupled to the first drive motor and the second drive motor to controllably rotate the middle housing by a first rotation angle with respect to the upper housing, and to controllably rotate the lower housing by a second rotation angle with respect to the upper housing to generate a bend angle between the middle housing and the lower housing at a target toolface orientation between the bend angle and the upper housing; and an angled bore formed in a lower end of the middle housing and operably coupled to an angled mandrel formed into an upper end of the lower housing such that relative rotation of the middle housing and the lower housing generates the bend angle.

16. The apparatus of claim 15 further comprising a constant velocity joint to operably couple the lower housing to the upper housing.

17. The apparatus of claim 15 wherein the controller is located at least one of the surface and downhole.

18. The apparatus of claim 15 wherein the controller is located downhole, the controller comprising a processor in data communication with a memory, the processor containing programmed instructions to autonomously control the bend angle and toolface to drill the wellbore along a predetermined path.

19. The apparatus of claim 15 wherein the controller actuates each of the first drive motor and the second drive motor sequentially to rotate the lower housing and the middle housing with respect to the upper housing.

* * * * *